United States Patent [19]

Di Blas et al.

[11] 3,942,983

[45] Mar. 9, 1976

[54] ELECTROLESS DEPOSITION OF A NON-NOBLE METAL ON LIGHT GENERATED NUCLEI OF A METAL MORE NOBLE THAN SILVER

[75] Inventors: Umberto Di Blas, Carcare (Savona); Franco Knirsch, Ferrania (Savona), both of Italy

[73] Assignee: Minnesota Mining and Manufacturing Company, St. Paul, Minn.

[22] Filed: June 9, 1967

[21] Appl. No.: 644,792

[52] U.S. Cl. ..... 96/48 PD; 96/88; 427/304; 427/305; 427/438; 96/49; 96/92

[51] Int. Cl.[2] ..... G03C 5/24; G03C 1/00

[58] Field of Search ..... 96/48 PD, 88, 49, 92; 117/212, 130 E; 428/19, 539; 427/304, 305, 438

[56] References Cited

UNITED STATES PATENTS

| | | | |
|---|---|---|---|
| 2,267,953 | 12/1941 | Schumpelt | 96/88 |
| 3,011,920 | 12/1961 | Shipley | 117/213 |
| 3,719,490 | 3/1973 | Yudelson et al. | 96/48 PD |

FOREIGN PATENTS OR APPLICATIONS

| | | | |
|---|---|---|---|
| 637,058 | 3/1964 | Belgium | 96/48 PD |

*Primary Examiner*—Won H. Louie, Jr.
*Attorney, Agent, or Firm*—Alexander, Sell, Steldt & DeLaHunt

[57] ABSTRACT

This invention involves an imaging process in which a light image is projected onto a photosensitive medium having a layer capable upon light exposure of directly generating nuclei of a metal more noble than silver, such as palladium, which metal is catalytic to the electroless deposition of a non-noble metal, and thereafter selectively providing non-noble free metal onto the noble metal nuclei by electroless deposition, thereby providing a visible print of the original light image. The photosensitive layer in such media may comprise a compound of a metal more noble than silver and a photosensitive composition which can generate upon light exposure a reducing agent for said noble metal. In another embodiment, the photosensitive layer may contain a photoreducible metal salt which, upon light exposure, generates nuclei of a metal more noble than silver.

12 Claims, No Drawings

ELECTROLESS DEPOSITION OF A NON-NOBLE METAL ON LIGHT GENERATED NUCLEI OF A METAL MORE NOBLE THAN SILVER

This invention relates to a process for image recording and to photosensitive media for use therein.

In addition to the conventional photographic techniques many other processes for converting a light image into a visible print have been described in the literature. One approach utilized the ability of light to reduce ferric salts to ferrous salts, the ferrous ion then serving as a reducing agent for the reduction of noble metal ions to free noble metal. Among the several processes of this type are platinotype, palladiotype, iron-gold system, iron-mercury system and iron-silver (i.e. "brownprint") system, in which visible images are obtained by reduction to free metal of platinum, palladium, gold, mercury and silver ions. For the most part these processes have not found any practical application, principally because of the large quantities of expensive noble metals required.

In U.S. Pat. No. 3,223,525 a non-conductive support is treated with a light sensitive compound, such as silver halide, or a compound which produces, upon exposure to light, a reaction product capable of producing by reduction in the presence of water either silver or mercury atoms from water soluble silver or mercury salts. The treated support is then exposed to light to form a "germ image" or latent image and developed with a stabilized physical developer for a prolonged period of time to form a visible image of a noble metal, such as silver. This process is cumbersome and time consuming. In the process described in Belgian Pat. No. 637,058 the latent image of silver or mercury produced by light exposure is "activated" by treating the latent image areas with a solution of a salt of the platinum group, such as palladium chloride, to provide in the image area catalytic metal for the chemical or electroless deposition of a metal, such as nickel and/or cobalt. The procedures for electroless deposition of such metals onto catalytic sites are well known. Although this process affords a technique for preparing visible prints of a light image, it is quite complex and slow and requires the use of silver or mercury salts.

An object of the present invention is to provide a relatively simple and rapid procedure for preparing highly stable, visible prints of light images.

Still another object of this invention is to provide a process for image recording which does not require silver salts and which utilizes a photosensitive sheet that has good storage stability.

A further object of this invention is to provide novel photosensitive sheets which may be developed by electroless plating techniques after exposure without intermediate activating treatment with catalyst solutions.

Other objects and advantages will become apparent from the following description.

The process of the present invention comprises (*a*) exposing to a light image a photosensitive media having a layer in which is contained a composition which, upon light exposure, is capable of directly generating nuclei of a metal that is more noble than silver and is catalytic to the electroless deposition of a non-noble metal, and (*b*) providing said non-noble metal selectively on said nuclei by electroless deposition to provide a visible print of said light image. In the practice of this process the catalytic metal is preferably palladium, and the non-noble metal forming the visible image is preferably copper, nickel, cobalt or a mixture thereof. In one preferred embodiment the composition which generates nuclei of the catalytic metal directly upon light exposure comprises a salt of the catalytic metal and a light sensitive compound which generates, upon light exposure, a reducing agent for said catalytic metal salt. For example, when the catalytic metal salt is a palladium salt, a ferric salt which can generate ferrous ion upon light exposure in the presence of moisture may be used. Organic ferric salts, such as ferric ammonium oxalate, ferric potassium oxalate, ferric ammonium citrate and ferric ammonium tartrate are reducible to form ferrous ions upon light exposure. Inorganic ferric salts may be used together with a reducing agent to form ferrous ions upon light exposure, and a preferred oxidation-reduction system is ferric chloride-oxalic acid. The ferrous ion generated by the exposure serves to reduce the catalytic metal ion or radial (e.g. $Pd^{+2}$) to free catalytic metal nuclei (e.g. $Pd^0$). In another preferred embodiment the composition which generates nuclei of the catalytic metal directly upon light exposure comprises a photoreducible salt of the catalytic metal, as exemplified by palladium ammonium oxalate. Both of these embodiments produce catalytic metal nuclei in the photosensitive layer directly upon light exposure, although the application of heat may be used to accelerate the rate of reaction and improve the yield of catalytic metal nuclei in the image areas. The photosensitive layer preferably also contains hydrophilic polymers, such as polyether glycols (e.g. polyethylene glycols), polyvinyl alcohol, carboxymethylcellulose, gelatin or aqueous emulsions of various polymers. Minor amounts of a surfactant have also been found to offer beneficial effects. It is a surprising feature of this invention that the catalytic metal nuclei can be readily generated in this direct manner and that the resulting latent image of catalytic metal nuclei is sufficient to permit successful development by electroless deposition without intervening activation baths and to produce good quality prints.

The development of the latent image formed by the free catalytic metal utilizes well known electroless deposition procedures, as illustrated by U.S. Pat. Nos. 2,532,284; 2,690,401; 2,690,402; 2,726,969; 2,762,723; 2,871,142 and 3,011,920. Electroless deposition of metals involves the reduction of the metal ion and the simultaneous oxidationn of a reducing agent on catalytic surfaces, resulting in the deposition of free metal atoms on the catalytic surfaces. The deposition baths generally comprise salts of the metal to be deposited (e.g. $NiCl_2 . 6H_2O$; $CUSO_4 . 5H_2O$, etc.) reducing agents (e.g. sodium hypophosphite, formaldehyde, hydrazine), complexing agents to prevent fog and buffering agents (e.g. tartrates, citrates, oxalates, etc.). The catalytic metals are preferably selected from the noble metals, particularly the metals more noble than silver, such as platinum, palladium, gold, etc. Palladium is the most preferred catalytic metal. Although many non-noble metals can be electrolessly deposited, including nickel, cobalt, copper, iron, chromium, etc., the use of nickel, cobalt or a mixture thereof has produced outstanding images which have excellent black rendition and which are very stable.

When the photosensitive media as described above is exposed to a light source, particularly a light source having a high ultraviolet light output, a very faint or invisible latent image is formed by the nuclei of catalytic free noble metal in the exposed areas. A slight amount of moisture is desired in the photosensitive layer, although the layer may be dried to all appearance and touch. The exposed media is then immersed in the electroless deposition bath or contacted with developer solution in some other manner until a visible image of the desired density is produced. A subsequent water wash is desirable to remove excess developer, and the media is then allowed to dry. Prints produced in this manner have high definition, good density in black areas, and outstanding stability to aging. The image areas appear to adhere very well to the support.

The photosensitive media usually comprises the photosensitive layer on a suitable support, including various types of paper and transparent supports such as saponified diacetate and triacetate, as well as cellophane, polystyrene, polyesters, and any other suitable adequately subbed, support or film base of the kind useful in the photographic field.

The following examples are presented for purposes of illustrating this invention.

EXAMPLE 1

Into one liter of distilled water containing 4 ml. of 37% hydrochloric acid one gram of palladium chloride was dissolved, then 10 grams of ethylenediaminetetraacetic acid disodium salt was added as a complexing agent. A white precipitate which formed was dissolved by adding dropwise concentrated ammonium hydroxide until the pH was about 3.5. To this solution was added 20 grams of ferric potassium oxalate, 40 grams of polyethylene glycol (E-1450, Dow Chemical Company) and 2 ml. of polyoxyethylated fatty alcohol surfactant ("Tinegal NA", Geigy Chemical Company). The resulting solution was coated onto the surface of a paper sheet of the type used for printing documents and dried. After exposure through a negative original to an ultraviolet ray source (five 20 watt fluorescent tubes spaced about 20 cm. from the plane of exposure), the photosensitive sheet was developed by immersion for about 2 minutes into an electroless deposition bath (pH of 9, temperature of 80°C.) of the following composition:

| | |
|---|---|
| Distilled water | 1000 ml. |
| Nickel chloride hexahydrate | 40 grams |
| Cobalt chloride hexahydrate | 20 grams |
| Sodium potassium tartrate tetrahydrate | 200 grams |
| Ammonium chloride | 50 grams |
| Glycine | 20 grams |
| Succinic acid | 7 grams |
| Sodium hypophosphite hydrate | 30 grams |

Sodium hydroxide to adjust pH to 9

A black positive Ni-Co image with high density and good definition was obtained. After rinsing with water and drying, the stable print maintained its quality over an extended period of time.

EXAMPLE 2

The photosensitive solution of Example 1 was coated onto saponified diacetate and triacetate sheet. After drying and exposing to a negative light image, the sheet was developed as in Example 1. A black image having high density and excellent definition was produced.

EXAMPLE 3

The photosensitive medium of Example 1 was exposed then developed in a room temperature "developer" bath of the following composition:

| | |
|---|---|
| Distilled water | 1000 ml. |
| Copper sulfate pentahydrate | 30 grams |
| Anhydrous sodium carbonate | 30 grams |
| Sodium potassium tartrate | 100 grams |
| Sodium hydroxide | 50 grams |
| 37% formaldehyde | 30 ml. |

A print of the original negative light image was obtained.

EXAMPLE 4

One gram of palladium chloride was dissolved in one liter of distilled water containing 4 ml. of 37% hydrochloric acid, and the pH was adjusted to 8.5 with ammonia. Then 20 grams of oxalic acid, 40 grams of polyethylene glycol (E-6000, Dow Chemical Company) and a small amount of polyoxyethylated fatty alcohol ("Tinegal NA", Geigy Chemical Company) were added. The resulting solution was coated onto paper and dried to provide a photosensitive sheet which was exposed and developed with the bath and technique of Example 1 to provide a negative print of the original light image.

Various other embodiments of the present invention will be apparent to those skilled in the art without departing from the scope thereof.

The embodiments of the invention in which an exclusive property or privilege is claimed are defined as follows:

1. An imaging process which comprises a. exposing to a light image photosensitive medium having a photosensitive layer comprising a composition which upon light exposure is capable of directly generating nuclei of a metal which is more noble than silver and is catalytic to the electroless deposition of a non-noble metal, and b. providing non-noble free metal selectively on said nuclei by electroless deposition to provide a visible print of said light image.

2. The imaging process of claim 1 in which said catalytic metal nuclei are nuclei of palladium.

3. The imaging process of claim 1 in which said non-noble free metal comprises cobalt, nickel, copper or a mixture thereof.

4. The process of claim 1 in which said photosensitive layer comprises a compound of metal more noble than silver and a photosensitive composition capable of generating upon light exposure a reducing agent for said metal more noble than silver.

5. The process of claim 4 in which said compound of a metal more noble than silver is a reducible palladium compound and said photosensitive composition is a composition capable of generating ferrous ions upon light exposure.

6. The process of claim 1 in which said photosensitive layer comprises a photosensitive metal compound in which said metal is more noble than silver and is reducible to free metal nuclei upon light exposure.

7. The process of claim 6 in which said photosensitive metal compound is a photosensitive palladium compound.

8. An image record comprising a layer having light-exposed image areas containing light-generated nuclei of a metal more noble than silver, said nuclei selectively bearing a visible deposit of a non-noble metal.

9. The image record of claim 8 wherein said light-generated nuclei are nuclei of palladium.

10. The image record of claim 8 wherein said non-noble metal is nickel, cobalt, copper, or a mixture thereof.

11. An imaging process which comprises a. exposing to a light image a photosensitive medium having a photosensitive layer comprising a composition including a palladium compound, said composition being capable upon light exposure of directly generating palladium nuclei which are catalytic to the electroless deposition of a non-noble metal, and b. electrolessly depositing nickel, cobalt, or copper or a mixture thereof on said nuclei to provide a visible print of said light image.

12. An image record which includes a layer having light-generated palladium nuclei in light-imaged areas thereof, said nuclei selectively bearing a visible electroless deposit of nickel, cobalt or copper or a mixture thereof.

* * * * *